US006796868B2

(12) United States Patent
Konishi et al.

(10) Patent No.: US 6,796,868 B2
(45) Date of Patent: Sep. 28, 2004

(54) METHOD FOR MANUFACTURING PLASMA DISPLAY PANEL

(75) Inventors: Tsuneo Konishi, Tokyo (JP); Ken Ito, Tokyo (JP)

(73) Assignee: NEC Corporation, Tokyo (JP)

( * ) Notice: Subject to any disclaimer, the term of this patent is extended or adjusted under 35 U.S.C. 154(b) by 28 days.

(21) Appl. No.: 10/050,972

(22) Filed: Jan. 22, 2002

(65) Prior Publication Data

US 2002/0111103 A1 Aug. 15, 2002

(30) Foreign Application Priority Data

Feb. 13, 2001 (JP) ..... 2001-035285

(51) Int. Cl.[7] ..... H01J 9/26

(52) U.S. Cl. ..... 445/25

(58) Field of Search ..... 445/24, 25; 220/2.1 R, 220/2.2

(56) References Cited

U.S. PATENT DOCUMENTS

| | | | | |
|---|---|---|---|---|
| 5,697,825 A | * | 12/1997 | Dynka et al. | 445/25 |
| 5,964,630 A | * | 10/1999 | Slusarczuk et al. | 445/25 |
| 6,036,567 A | * | 3/2000 | Watkins | 445/25 |
| 6,309,272 B1 | * | 10/2001 | Nishimura | 445/25 |
| 6,332,821 B1 | * | 12/2001 | Park et al. | 445/25 |

FOREIGN PATENT DOCUMENTS

JP 9-251839 9/1997

* cited by examiner

*Primary Examiner*—Renee Luebke
*Assistant Examiner*—Felix O. Figueroa
(74) *Attorney, Agent, or Firm*—Sughrue Mion, PLLC

(57) ABSTRACT

A front substrate and a rear substrate are laid on each other with a sealing frit therebetween. The front substrate, the rear substrate and the sealing frit are heated in a chamber and impurity gas is exhausted from both of the substrates by lowering internal pressure of the chamber. The sealing frit is melted in the chamber by further heating the front substrate, the rear substrate and the sealing frit. The sealing frit is solidified in the chamber and sealing up the front substrate and the rear substrate.

22 Claims, 8 Drawing Sheets

METHOD FOR MANUFACTURING PLASMA DISPLAY PANEL

BACKGROUND OF THE INVENTION

1. Field of the Invention

The present invention relates to a method for manufacturing a plasma display panel suitable as a flat display panel, more particularly to a method for manufacturing a plasma display panel designed to shorten the time required to exhaust impurity gas that has been adsorbed into a substrate.

2. Description of the Related Art

According to a conventional method, when a color plasma display panel (hereinafter referred to as a "color PDP") is manufactured, a scanning electrode, a sustaining electrode and the like are formed on a glass substrate so as to form a front substrate, and a data electrode and the like are formed on another glass substrate so as to form a rear substrate, and thereafter the front and rear substrates are sealed up by a continuous furnace in the atmosphere. Gases are then exhausted from a discharge space formed between the substrates by sealing. FIG. 1 is a graph showing change of temperature in a conventional method for sealing a color PDP, and FIG. 2 is a graph showing change of temperature in an exhaust process after the color PDP is sealed up by the conventional method.

In a conventional sealing method, a glass frit is first applied onto the edge of a rear substrate, and a front substrate is laid thereon. Thereafter, in a furnace that is filled with atmosphere, the temperature thereof is raised to 450° C. in 1.5 hours as shown in FIG. 1, thereafter is maintained for 30 minutes at 450° C., and is lowered to a normal temperature in about 3.5 hours. The glass frit is melted and solidified through the thermal treatment, so that the front and rear substrates are sealed up, and a panel structure of a color PDP is formed.

Thereafter, an exhaust pipe pre-connected to the rear substrate is connected to an exhaust system that has a vacuum pump and the like, thereby exhausting gas from the panel structure, and heating (baking) the panel structure. As a result, the moisture and gas that have been adsorbed in a protective film made of a MgO film and the like are removed. The heating (baking) process is carried out to activate MgO (i.e., to decompose magnesium hydroxide), and, in consideration of the melting point of the glass frit for sealing, the temperature thereof is roughly 380° C., and the time period is 15 to 25 hours as shown in FIG. 2. Gas cleaning is also carried out by introducing a cleaning gas into the panel structure while being heated as shown in FIG. 2. Further, the discharge space is filled with a discharge gas after the temperature is lowered, thereby completing the color PDP.

However, in the manufacturing method, just when the gas begins to be exhausted through the exhaust pipe of the panel structure after they are sealed up, the front and rear substrates are pressurized by the atmospheric pressure, and an exhaust passage in the panel structure is pressed, and therefore conductance decreases. Further, since the gas is exhausted outside through the exhaust pipe, conductance in a piping system as well as in the panel structure is low. This lengthens the heating/exhausting time required to exhaust the impurity gas, which has been removed by baking, so as to clean the panel. Further, in a recently developed PDP, there is a case in which a closed cell structure in which each discharge cell is partitioned by ribs is employed to prevent interference of discharge between the discharge cells.

However, in this structure, the exhaust passage in the panel structure becomes extremely small. Therefore, the time required to carry out the baking process and to exhaust the impurity gas is lengthened more than in a conventional PDP having a stripe cell structure, thus obstructing the productivity of the PDP considerably. Further, since a phosphor layer is heated in a vacuum for a long time proportionate to the lengthened exhausting/baking time, the phosphor layer is greatly damaged.

For these reasons, a PDP manufacturing method has been proposed for exhausting gases accumulating in the panel structure in a short time (Japanese Unexamined Patent Publication No. Hei 9-251839). According to the conventional manufacturing method described in this publication, a sealing agent is first applied onto one of two glass substrates, and these glass substrates are spaced out in a chamber. Thereafter, the glass substrates are degassed by heating them and carrying out vacuum evacuation of the chamber, and, under this state, one of the glass substrates is mechanically laid on the other glass substrate. Thereafter, the sealing agent is melted by further raising the temperature, and the glass substrates are sealed up with the sealing agent by lowering the temperature. A discharge gas is introduced through a chip tube pre-connected to one of the glass substrates before carrying out vacuum evacuation, or is introduced by filling the chamber with the discharge gas.

However, in the conventional manufacturing method described in Japanese Unexamined Patent Publication No. Hei 9-251839, the glass substrates as a pair, which are placed separately from each other in the chamber, are baked, and the glass substrates should be mechanically laid on each other. Therefore, structure and control for positional adjustment or similar adjustment are largely complicated, and, disadvantageously, costs rise. Further, since the procedure from the sealing step to the gas filling step is continuously performed, the exhaust pipe is connected to a discharge gas introduction mechanism disposed outside the chamber after the glass substrates are disposed in the chamber, or the chamber is filled with the discharge gas. In the method for connecting the exhaust pipe to the discharge gas introduction mechanism, the structure and control of a sealing device are further complicated. On the other hand, in the method for filling the chamber with the discharge gas, the amount of consumption of the discharge gas becomes extremely large, and a great disadvantage in cost exists. Further, since the pressure in the chamber becomes larger than the atmospheric pressure, it is needed to take measures against using the chamber as a container which endures an internal pressure, and a disadvantage also exists on equipment.

SUMMARY OF THE INVENTION

It is an object of the present invention to provide a method for manufacturing a plasma display panel capable of shortening the exhausting time of impurity gas without complicating the structure of a sealing device and its control.

A method for manufacturing a plasma display panel according to the present invention comprises the steps of: laying a front substrate and a rear substrate on each other with a sealing frit therebetween; heating the front substrate, the rear substrate and the sealing frit in a chamber and exhausting impurity gas from both of the substrates by lowering internal pressure of the chamber; melting the sealing frit in the chamber by further heating the front substrate, the rear substrate and the sealing frit; and solidifying the sealing frit in the chamber and sealing up the front substrate and the rear substrate.

In the present invention, the front and rear substrates are laid on each other with the sealing frit therebetween, and the impurity gas is exhausted. After the impurity gas is exhausted, the substrates are sealed up merely by melting and solidifying the sealing frit in the same chamber. Therefore, a positional adjustment between the front and rear substrates can be easily made without complicating the structure of the sealing device. In other words, since the front and rear substrates are laid on each other and are fastened, i.e., since the substrates have no need to be moved by a carrying device or the like, the structure of the sealing device and the control thereof including the chamber in which thermal treatment and the like are carried out are not required to be complicated when the impurity gas is exhausted. Further, since the impurity gas is exhausted while lowering the internal pressure of the chamber, the impurity gas easily flows out from between the substrates. At this time, since the space between the substrates is not completely sealed up by the sealing frit, the impurity gas is exhausted from therebetween as well as from the chip tube. Therefore, sufficient exhaust conductance is obtained.

DETAILED DESCRIPTION OF THE PREFERRED EMBODIMENTS

Figure 1:
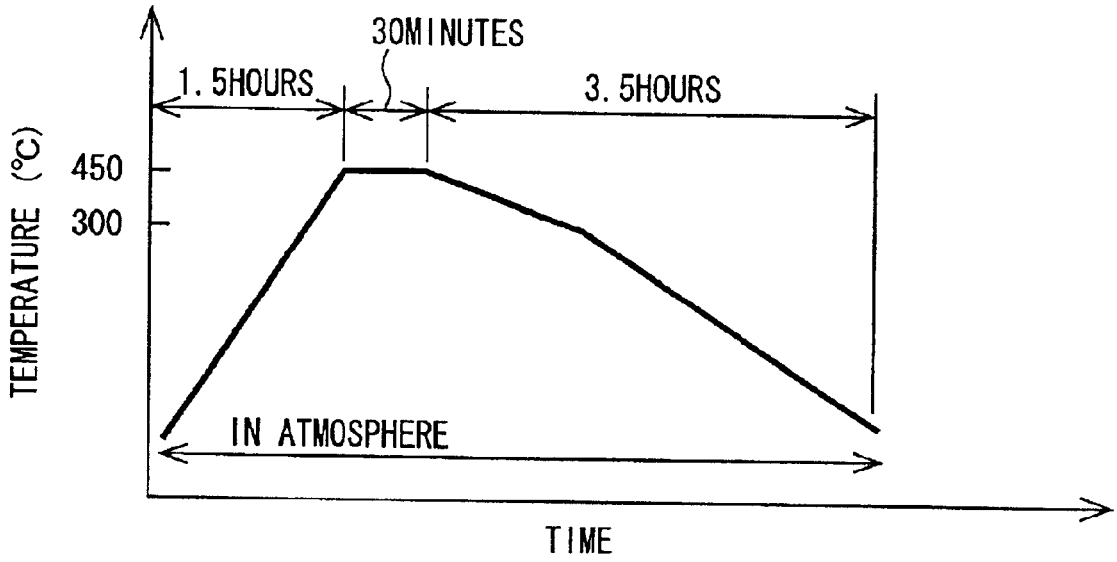
FIG. 1 (PRIOR ART)
FIG. 1 is a graph showing change of temperature in the conventional sealing method of a color PDP.
Figure 2:
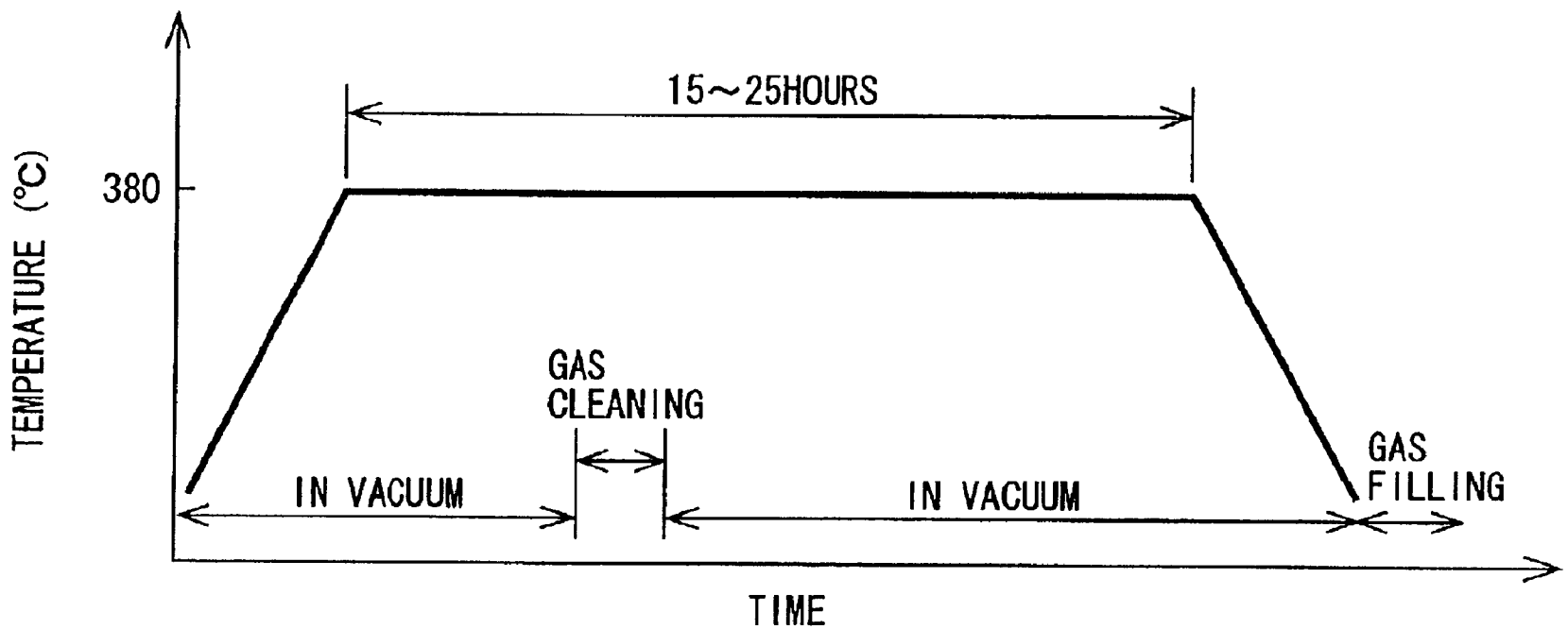
FIG. 2(PRIOR ART)
FIG. 2 is a graph showing change of temperature at an exhausting step after the color PDP is sealed up according to the conventional method.
Figure 3:
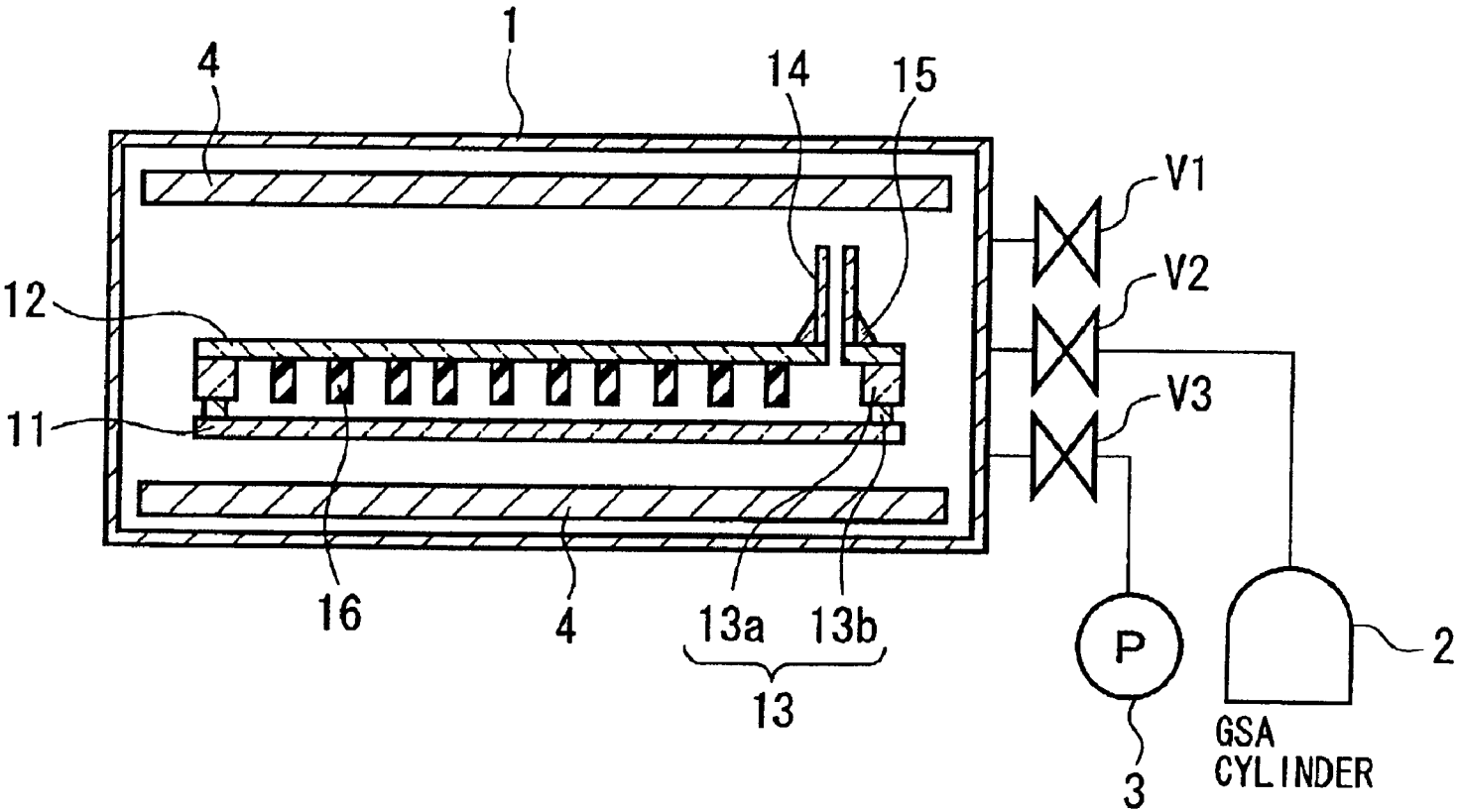
FIG. 3 is a sectional view of the structure of a sealing device used in a method for manufacturing a color PDP according to an embodiment of the present invention.

A preferred embodiment of the present invention will be hereinafter described in detail with reference to the attached drawings. FIG. 3 is a sectional view showing the structure of a sealing device used in a method for manufacturing a color PDP according to an embodiment of the present invention.

In the sealing device used in the present embodiment, a release valve V1, a gas introduction valve V2, and an exhaust valve V3 are provided to a chamber 1. Outside the chamber 1, a gas cylinder 2 is connected to the gas introduction valve V2, and a vacuum pump 3 is connected to the exhaust valve V3.

A front substrate supporting device (not shown) for supporting a front substrate 11 and a rear substrate supporting device (not shown) for supporting a rear substrate 12 above the front substrate 11 are provided in the chamber 1. Heaters 4 between which the front and rear substrates 11 and 12 are disposed are provided in the chamber 1.

Figure 4:
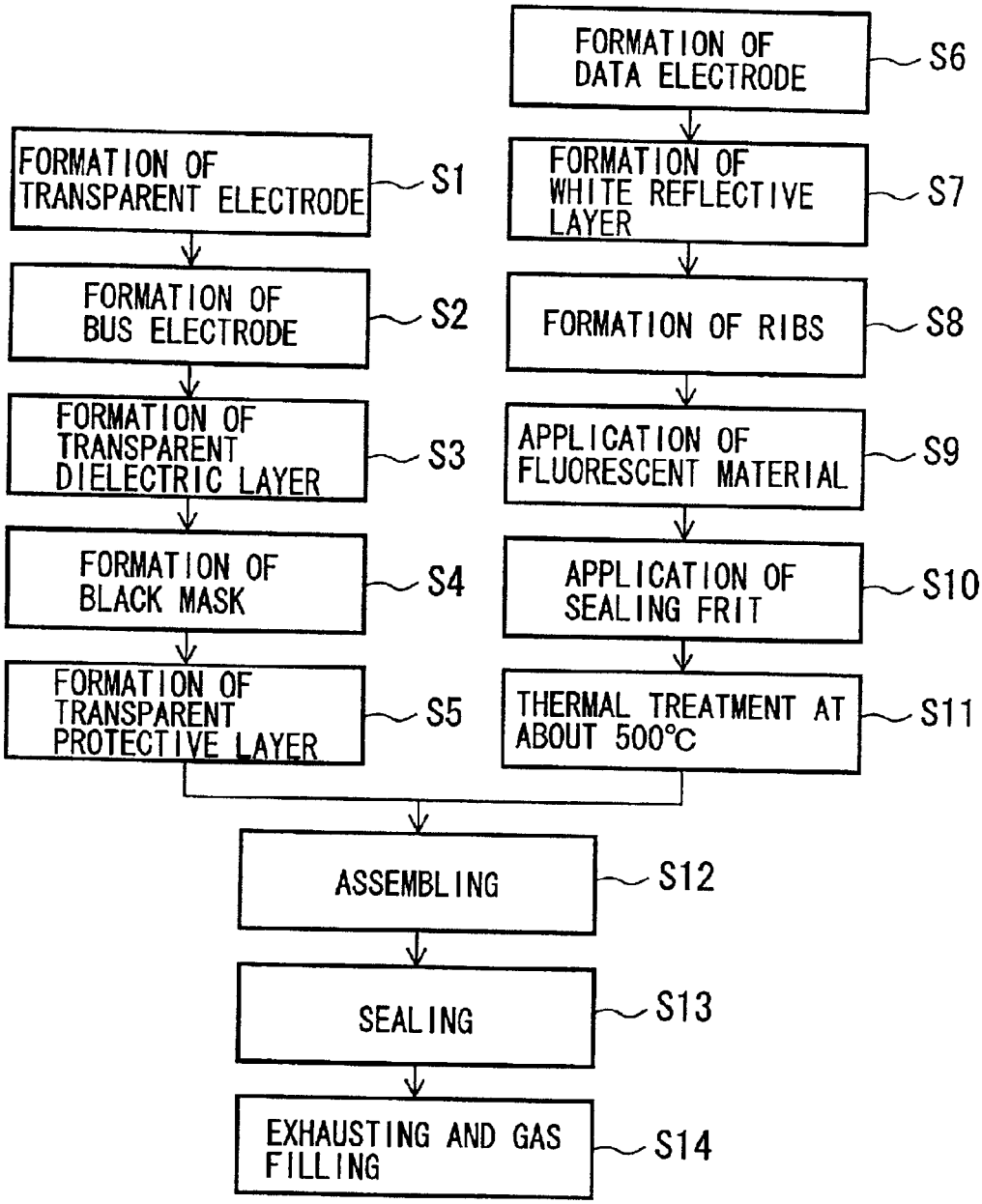
FIG. 4 is a flowchart showing the method for manufacturing a color PDP according to the embodiment of the present invention.
Figure 5:
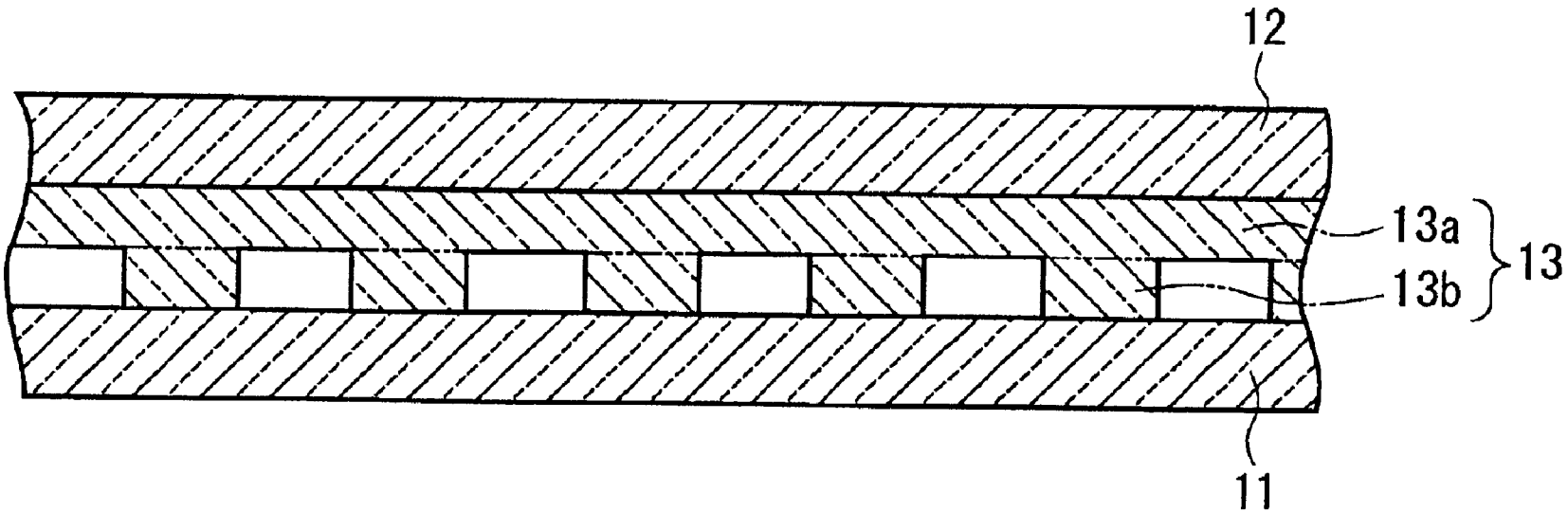
FIG. 5 is a sectional view of the edge of a panel structure.
Figure 6:
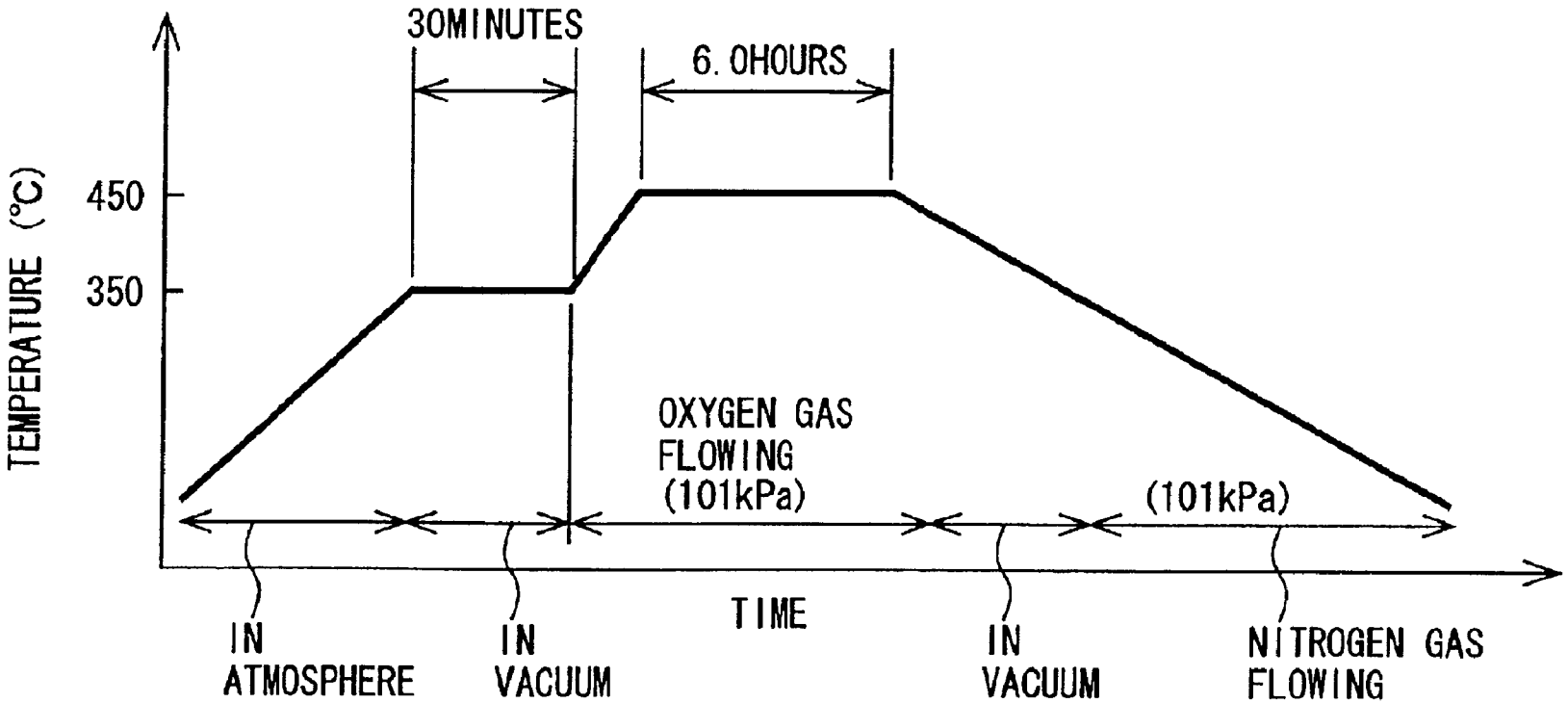
FIG. 6 is a graph showing change of temperature at a sealing step in the embodiment of the present invention.
Figure 7:
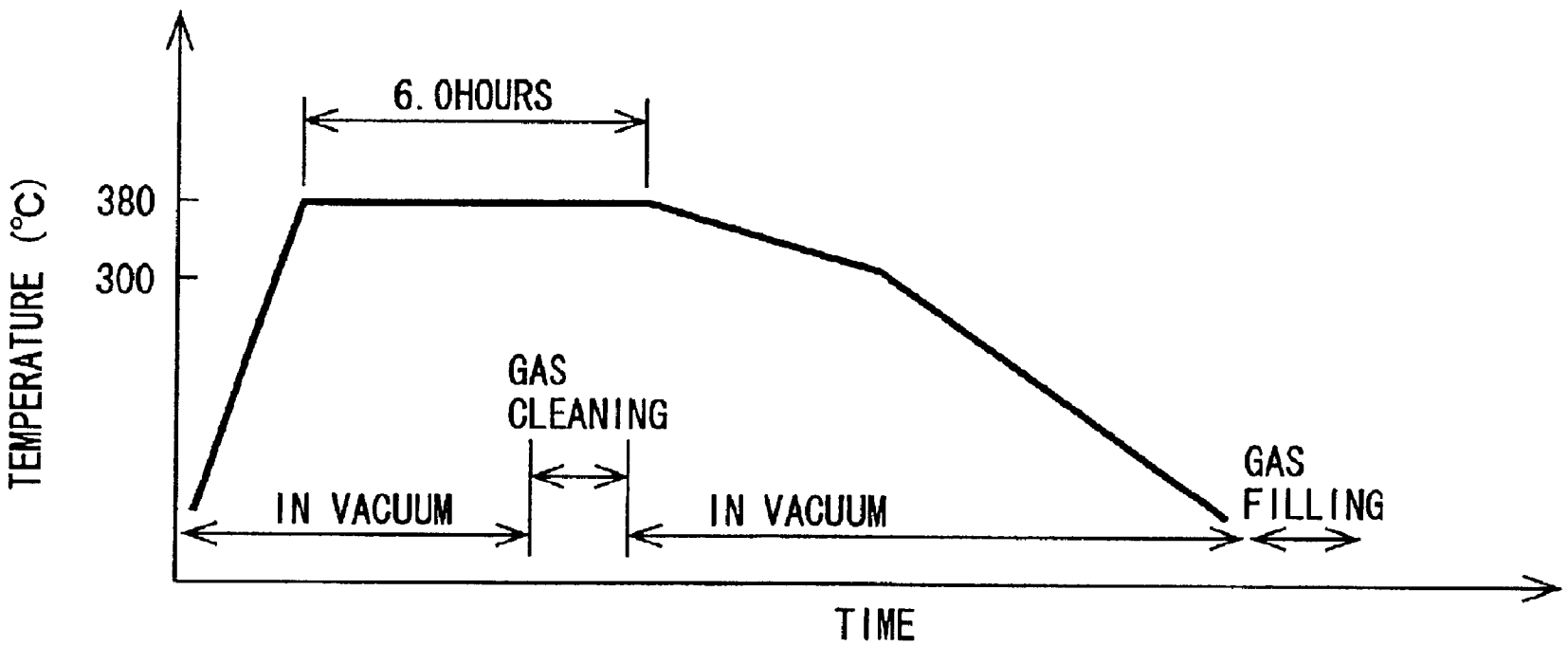
FIG. 7 is a graph showing change of temperature at an exhausting step in the embodiment of the present invention.

Next, a description will be given of a method for manufacturing a color PDP that uses the sealing device constructed as described above. FIG. 4 is a flowchart showing a method for manufacturing a color PDP according to the present embodiment. FIG. 5 is a sectional view of the edge of a panel structure. FIG. 6 is a graph showing change of temperature at a sealing step in the present embodiment. FIG. 7 is a graph showing change of temperature at an exhausting step in the present embodiment.

First, the front substrate 11 and the rear substrate 12 are formed.

In order to form the front substrate 11, transparent electrodes as scanning electrodes and sustaining electrodes are formed on a glass substrate (Step S1). Thereafter, in order to compensate the conductivity of the transparent electrodes, metallic bus electrodes are formed on the transparent electrodes (Step S2). A transparent dielectric layer is further formed on the whole surface (Step S3). Thereafter, a black mask with a predetermined shape is formed (Step S4). Then, a MgO protective film is formed on the whole surface (Step S5).

In order to form the rear substrate 12, data electrodes are formed on a glass substrate for the rear substrate (Step S6). Thereafter, a white reflective layer (dielectric layer) is formed on the whole surface (Step S7). Then, ribs 16 are formed to partition discharge cells (Step S8). A gap (discharge space) between the front and rear substrates is secured by the ribs 16. Thereafter, a phosphor that emits predetermined color light is applied onto side faces of ribs 16 and onto an exposed surface of the white reflective layer (Step S9). Thereafter, a glass frit (sealing frit) 13 made of, for example, amorphous glass with a low softening temperature is applied onto the edge of a display screen by use of a dispenser (Step S10). When the glass frit 13 is applied, a glass frit 13*a* is first applied continuously with a predetermined pattern, and a glass frit 13*b* is further applied thereon intermittently. As a result, a difference in the height of the glass frit 13 arises between the part where the glass frits 13*a* and 13*b* have been formed and the part where only the glass frit 13*a* has been applied. In other words, the glass frits 13*a* and 13*b* are applied onto the edge of the display screen of the rear substrate so as to produce a level difference. Thereafter, thermal treatment is carried out at about 500° C. both for baking of the phosphor and for pre-baking of the glass frit (Step S11). Further, a glass tube (chip tube) 14 for exhaust is temporarily fixed by a crystallized glass frit (fixing frit) 15 on the side of a surface different from the surface where the data electrodes and the like have been formed.

The front substrate can be formed earlier or later than the rear substrate, or the front and rear substrates can be formed simultaneously.

After the front and rear substrates are formed, the panel structure is built by temporarily fastening the front and rear substrates with, for example, a heat resistant clip such that the electrodes formed on both of the substrates face each other, i.e., such that these are located internally (Step S12).

Thereafter, the panel structure is disposed in the chamber 1 of the sealing device shown in FIG. 3. At this time, because of the level difference obtained by the glass frit 13, gaps exist between the front and rear substrates 11 and 12 at the edge of the panel structure as shown in FIG. 5. Thereafter, the color PDP is sealed up (Step S13). At this sealing step, the exhaust valve V3 is opened, and the inside of the chamber 1 is heated by the heater 4 to about 350° C. as shown in FIG. 6 while carrying out the vacuum evacuation of the chamber 1 by actuating the vacuum pump 3, and, when it reaches 350° C., the inside of the chamber 1 is kept at this temperature for about 30 minutes in a vacuum. As a result, the front and rear substrates 11 and 12 are baked, and impurity gas that has been adsorbed in each substrate is discharged therefrom. The impurity gas is guided outside the panel structure through the gaps between the front and rear substrates 11 and 12, and is exhausted outside through the vacuum pump 3. The temperature to be reached and the time to be kept are not limited to 350° C. and 30 minutes, respectively, and they are set at such levels so as not to melt the glass frit. Additionally, the pressure does not necessarily need to be always in a reduced state when the impurity gas is exhausted, and an oxygen gas, an inert gas, and/or dry air can be temporarily introduced into the chamber 1 in order to control the atmosphere in the chamber 1.

Thereafter, a gas cylinder for an oxygen gas is prepared as the gas cylinder 2, and the exhaust valve V3 is closed, and the gas introduction valve V2 is opened. Thereby, an oxygen gas is introduced from the gas cylinder 2 into the chamber 1. after the pressure inside the chamber 1 reaches atmospheric pressure, the temperature is raised to about 450° C. in the chamber 1 as shown in FIG. 6, and, when it reaches 450° C., the temperature is kept for approximately 6.0 hours in the oxygen atmosphere to melt the glass frit 13. Preferably, the speed at which the temperature is raised is 6° C./minute or more so that a crystallized glass frit 15 through which a glass tube 14 for exhaust is fixed to the glass substrate is melted before completely crystallized. The reason why the oxygen gas is introduced into the chamber 1 is that oxygen is needed to melt and solidify the glass frit 13 and the glass frit 15 used to fix the glass tube 14 for exhaust.

Thereafter, the panel structure is cooled as shown in FIG. 6. When the glass frit 13 is melted, impurity gas is discharged and remains in the panel structure. Therefore, in order to exhaust the impurity gas, the gas introduction valve V2 is closed and the exhaust valve V3 is opened after the glass frit 13 is solidified to discharge the gas remaining in the chamber 1 at the cooling step. The temperature at which the glass frit 13 is solidified is about 400° C. The panel structure is slowly cooled to approximately 300° C. for preventing the panel structure from cracking. Thereafter, a gas cylinder for a nitrogen gas is prepared as the gas cylinder 2, and the exhaust valve V3 is closed, and the gas introduction valve V2 is opened. The panel structure is cooled to a normal temperature while introducing a nitrogen gas into the chamber 1. Thereafter, the gas introduction valve V2 is closed, and the release valve V1 is opened. Thereby, the inside of the chamber 1 is exposed to the atmosphere, and the panel structure is extracted from the chamber 1.

Thereafter, the impurity gas is exhausted from the discharge space, and the discharge space is filled with a discharge gas (Step S14). At this step, the panel structure is first connected to an exhauster and to a gas introduction device through the glass tube 14 for exhaust. Thereafter, as shown in FIG. 7, the entire panel structure is heated to 380° C. while performing the vacuum evacuation of the discharge space by use of the exhauster, and is kept at the temperature for several hours (e.g., six hours). A cleaning gas may be temporarily introduced into the discharge space during the preservation. Thereafter, like the sealing step, the panel structure is slowly cooled to 300° C. to prevent it from cracking. Thereafter, the panel structure is cooled to a normal temperature, and the discharge space is filled with a discharge gas through the glass tube 14 under a predetermined gas pressure. Thereafter, the glass tube 14 for exhaust is chipped off, and an AC (alternating current) three-electrode surface discharge type PDP is completed.

According to the present embodiment, gaps are formed between the front and rear substrates by the glass frit 13 having a level difference, and impurity gas is exhausted in a state in which conductance is sufficiently secured, and therefore the time required for this exhaust is remarkably shortened, in comparison with the conventional manufacturing method in which the front substrate is laid on the rear substrate by sealing, and the impurity gas is exhausted from the discharge space through the exhaust pipe.

Figure 8:
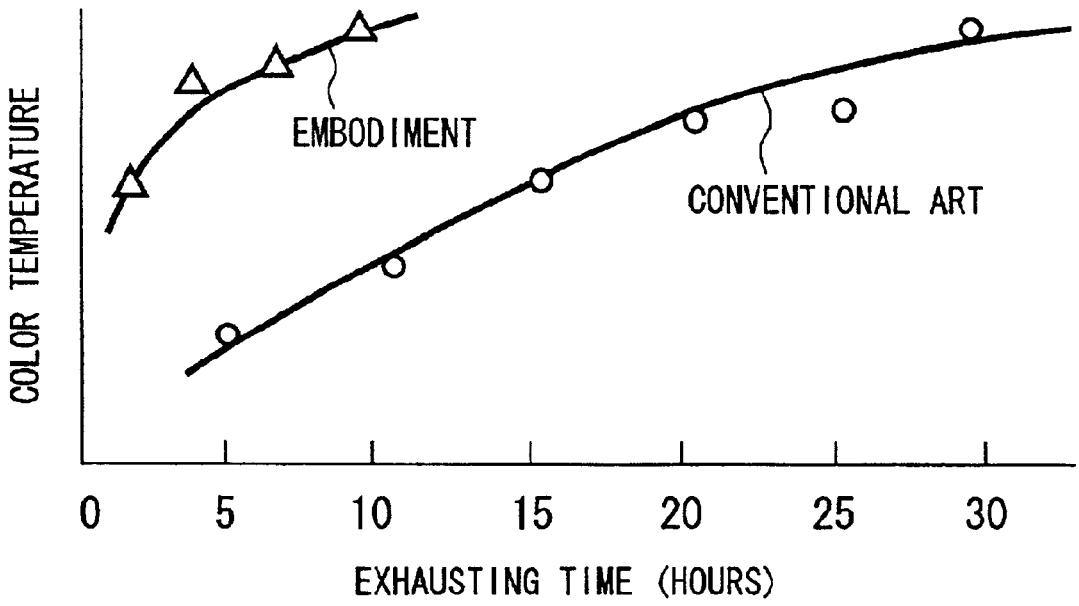
FIG. 8 is a graph showing the relationship between the exhausting time and a color temperature in a PDP manufactured according to the conventional method and in a PDP manufactured according to an embodiment of the present invention.

The color temperature of a luminescent color can be mentioned as a panel luminescence characteristic that reflects the exhausting time. FIG. 8 is a graph showing the relationship between the exhausting time and the color temperature in a PDP manufactured according to the conventional method and the relationship therebetween in a PDP manufactured according to the embodiment of the present invention, in which the horizontal axis shows the exhausting time, and the vertical axis shows the color temperature. As shown in FIG. 8, according to the embodiment of the present invention, an effective exhausting time for obtaining a color temperature of the same level was shortened to the extent of about ⅕ to ⅓ of that of the conventional method.

Further, in the present embodiment, since the front and rear substrates 11 and 12 do not need to be mechanically moved after the substrates 11 and 12 are disposed in the chamber 1, sealing can be carried out by a sealing device having an extremely simple structure, and cost is greatly reduced, in comparison with the conventional method described in Japanese Unexamined Patent Publication No. Hei 9-251839.

Although the glass frit 13 is made of amorphous glass, and the glass frit 15 is made of crystallized glass in the aforementioned embodiment, the present invention is not limited to these. The sealing frit may be made of crystallized glass, and the fixing frit may be made of amorphous glass, or both of the frits may be made of crystallized glass or amorphous glass.

Further, the substrate onto which the sealing frit is applied is not limited to the rear substrate, and it may be applied onto the front substrate. Further, a first continuous frit may be applied to one of the substrates and a second frit is selectively applied onto an area that matches the first frit of the other substrate.

Further, in order to control the atmosphere in the chamber, an oxygen gas, an inert gas, and/or dry air may be temporarily introduced into the chamber under reduced pressure when the sealing frit is melted and solidified.

What is claimed is:

1. A method for manufacturing a plasma display panel, comprising:

laying a front substrate and a rear substrate on each other with a sealing frit therebetween;

heating said front substrate, said rear substrate and said sealing frit in a chamber and exhausting impurity gas from both of said substrates by lowering internal pressure of said chamber;

melting said sealing frit in said chamber by further heating said front substrate, said rear substrate and said sealing frit after the pressure of said chamber reaches atmospheric pressure; and solidifying said sealing frit in said chamber and sealing up said front substrate and said rear substrate.

2. The method for manufacturing a plasma display panel according to claim 1, wherein said melting said sealing frit and said sealing up said front and rear substrates are continuously carried out in said chamber.

3. The method for manufacturing a plasma display panel according to claim 1, wherein an exhaust pipe is connected to said rear substrate with a fixing frit, and at least one of said sealing frit and said fixing frit is made of crystallized glass.

4. The method for manufacturing a plasma display panel according to claim 2, wherein an exhaust pipe is connected to said rear substrate with a fixing frit, and at least one of said sealing frit and said fixing frit is made of crystallized glass.

5. The method for manufacturing a plasma display panel according to claim 1, further comprising a step of heating said front and rear substrates while depressurizing an inside of said chamber after said sealing up said front and rear substrates.

6. The method for manufacturing a plasma display panel according to claim 3, further comprising a step of heating said front and rear substrates while depressurizing an inside of said chamber after said sealing up said front and rear substrates.

7. The method for manufacturing a plasma display panel according to claim 4, further comprising a step of heating said front and rear substrates while depressurizing an inside of said chamber after said sealing up said front and rear substrates.

8. The method for manufacturing a plasma display panel according to claim 1, further comprising a step of filling a space between said front and rear substrates outside said chamber with a discharge gas.

9. The method for manufacturing a plasma display panel according to claim 1, wherein a level difference is provided to said sealing frit, and, said impurity gas is exhausted from a space between said front and rear substrates outside through gaps formed between said front and rear substrates by said level difference in said exhausting said impurity gas.

10. The method for manufacturing a plasma display panel according to claim 9, wherein said laying said front and rear substrates on each other comprises the steps of applying a first continuous frit to an edge of one of said front and rear substrates and selectively applying a second frit onto said first frit.

11. The method for manufacturing a plasma display panel according to claim 1, wherein said exhausting said impurity gas comprises a step of introducing at least one kind of gas selected from the group consisting of an oxygen gas, an inert gas, and dry air into said chamber.

12. The method for manufacturing a plasma display panel according to claim 1, wherein said melting said sealing frit and said solidifying said sealing frit each comprise a step of lowering internal pressure of said chamber.

13. The method for manufacturing a plasma display panel according to claim 3, wherein said melting said sealing frit and said solidifying said sealing frit each comprises a step of lowering internal pressure of said chamber.

14. The method for manufacturing a plasma display panel according to claim 4, wherein said melting said sealing frit and said solidifying said sealing frit each comprises a step of lowering internal pressure of said chamber.

15. The method for manufacturing a plasma display panel according to claim 1, wherein said melting said sealing frit and said solidifying said sealing frit each comprises a step of introducing at least one kind of gas selected from the group consisting of an oxygen gas, an inert gas, and dry air into said chamber.

16. The method for manufacturing a plasma display panel according to claim 3, wherein said melting said sealing frit and said solidifying said sealing frit each comprises a step of introducing at least one kind of gas selected from the group consisting of an oxygen gas, an inert gas, and dry air into said chamber.

17. The method for manufacturing a plasma display panel according to claim 4, wherein said melting said sealing frit and said solidifying said sealing frit each comprises a step of introducing at least one kind of gas selected from the group consisting of an oxygen gas, an inert gas, and dry air into said chamber.

18. The method for manufacturing a plasma display panel according to claim 1, wherein the pressure inside said chamber reaches atmospheric pressure when oxygen gas is introduced into said chamber.

19. The method for manufacturing a plasma display panel according to claim 2, wherein the pressure inside said chamber reaches atmospheric pressure when oxygen gas is introduced into said chamber.

20. The method for manufacturing a plasma display panel according to claim 3, wherein the pressure inside said chamber reaches atmospheric pressure when oxygen gas is introduced into said chamber.

21. The method for manufacturing a plasma display panel according to claim 5, wherein the pressure inside said chamber reaches atmospheric pressure when oxygen gas is introduced into said chamber.

22. A method for manufacturing a plasma display panel, comprising:

assembling a front substrate and a rear substrate in a face-to-face relationship with a sealing frit therebetween at edge portions thereof so as to form an inner space between said front substrate and said rear substrate with such a hole in said sealing frit that permits gas to flow out of said inner space to the outside, heating the assembled front and rear substrates to a first temperature in a chamber and exhausting impurity gas from said inner space through said hole, further heating said assembled front and rear substrates to a second temperature higher than said first temperature to melt said sealing frit in said chamber, and solidifying said sealing frit and sealing up said assembled front and rear substrates, wherein internal pressure of said chamber is lowered in said heating of the assembled front and rear substrates to said first temperature and oxygen gas is introduced in said chamber in said further heating of said assembled front and rear substrates to said second temperature.

* * * * *